US006823699B1

(12) United States Patent
Vero et al.

(10) Patent No.: US 6,823,699 B1
(45) Date of Patent: Nov. 30, 2004

(54) FABRIC WITH REINFORCING PARTS

(75) Inventors: Frederick A. Vero, East Hampton, NY (US); Fred Adams, Decatur, AL (US)

(73) Assignee: Lakeland Industries, Ronkonkoma, NY (US)

( * ) Notice: Subject to any disclaimer, the term of this patent is extended or adjusted under 35 U.S.C. 154(b) by 0 days.

(21) Appl. No.: 10/328,702

(22) Filed: Dec. 24, 2002

Related U.S. Application Data

(63) Continuation-in-part of application No. 10/060,718, filed on Jan. 30, 2002.

(51) Int. Cl.[7] ..... D04B 7/34

(52) U.S. Cl. ..... 66/171; 66/174; 66/232; 2/161.6; 2/167; 2/169

(58) Field of Search ..... 2/167, 169, 16, 2/161.6, 161.7, 2.5; 66/232, 174, 45, 196, 169 R, 171, 202; 700/141; 442/304, 312, 313, 318, 239, 243; 428/365

(56) References Cited

U.S. PATENT DOCUMENTS 2,342,547 A * 2/1944 Kuehnel ..... 2/158
4,377,195 A * 3/1983 Weil ..... 160/237
4,858,245 A * 8/1989 Sullivan et al. ..... 2/21
5,388,050 A * 2/1995 Inoue et al. ..... 700/131
5,511,394 A * 4/1996 Shima ..... 66/232
5,557,527 A * 9/1996 Kotaki et al. ..... 700/131
5,631,067 A * 5/1997 Anaf et al. ..... 428/213
5,881,572 A * 3/1999 Plemmons et al. ..... 66/65
5,965,223 A * 10/1999 Andrews et al. ..... 428/34.5
5,979,193 A * 11/1999 Murata ..... 66/169 R
6,021,523 A * 2/2000 Vero ..... 2/159
6,155,084 A * 12/2000 Andrews et al. ..... 66/174
6,182,477 B1 * 2/2001 Shibata et al. ..... 66/232
6,216,494 B1 * 4/2001 Essig et al. ..... 66/65
6,233,979 B1 * 5/2001 Plath ..... 66/232
6,582,794 B1 * 6/2003 Fransen ..... 442/318

FOREIGN PATENT DOCUMENTS

JP 01183560 A * 7/1989 ..... D04B/1/00

* cited by examiner

*Primary Examiner*—Rodney M. Lindsey
(74) *Attorney, Agent, or Firm*—John Lezdey

(57) ABSTRACT

A method for producing a multi layer protective textile fabric having a base fabric layer with pre-selected areas fibers of a heavier denier or different material inserted pursuant to a computer program and the articles produced thereby. There is also provided a glove prepared by the method comprising different denier fibers and kind of fibers at pre-selected locations having a base unilayer and at least one other layer.

20 Claims, 1 Drawing Sheet

FABRIC WITH REINFORCING PARTS

RELATED APPLICATIONS

This application is a continuation-in-part of application Ser. No. 10/060,718, filed Jan. 30, 2002.

FIELD OF THE INVENTION

The present invention relates generally to textile fibers with selective interlocking of an insertion fiber of a heavier denier and/or different fibers to produce garments and articles having enhanced performance characteristics. More particularly, the invention relates to protective work garments. The invention also relates to a method of producing a textile fabric having a base or bottom unilayer where insertion fibers are knitted into pre-selected locations within the base textile fabric and at least one layer is knitted on the top of the unilayer.

BRIEF DESCRIPTION OF THE PRIOR ART

The prior art has provided fabric of specific constructive design to overcome particular hazards encountered in the work environment. Generally in such construction, the patents disclose a composite requiring layers of high tensile modular filaments which may be further treated by dipping in a treating solution to form a protective fiber or by heat treatment. Such is the case in providing cut resistant fabric for gloves for use by metal workes, glass handlers, meat cutters, and medical personnel. Each requires protection from a different hazard. The metal workers and glass handlers typically do not need protection from fluids. On the other hand, meat cutters and medical personnel do need fluid protection to prevent bacterial or viral infection.

U.S. Pat. No. 4,004,295 discloses a glove constructed of yarn and metal wire and a non-metallic fiber such as an aramide fiber as protection from knife cuts.

U.S. Pat. No. 5,651,514 relates to a yarn composed of a monofilament nylon core that is wrapped with at least one stand of aramide fiber and a strand of nylon fiber. This yarn is electronically conductive.

Other special fabrics are designed for firefighters, foundry workers, and personnel in the chemical and related industries. Again, additional protection beyond the cut and puncture resistance is required. Generally, this again involves protecting the skin from hazardous liquid chemicals. These include solvents, paints, varnishes, glues, cleaning agents, degreasing agents, drilling fluids, inter alia.

U.S. Pat. Nos. 4,479,368 and 4,608,642, which are herein incorporated by reference disclose programmable knitting machines that may be used in preparing the fabrics of the invention.

U.S. Pat. No. 4,302,851 to Adair discloses a heat resistant protective hand covering in which a wool knit liner is enclosed within an outer layer of woven KEVLAR® aromatic polyamide fiber material with layers of aluminum foil and flexible fiberglass sandwiched there between a pleated pad of flexible material woven from fiberglass yarns.

U.S. Pat. No. 4,433,479 to Sidman et al, relates to a heat resistant glove having first and second shells formed of temperature-resistant aromatic polyamide fibers such as KEVLAR® with the first shell section being made of a twill weave fabric and the second shell being made of a knitted fabric. A liner is formed of two sections, both are made of a felt feabric of temperature resistant aromatic polyamide fibers with the section forming the palm being provided with a flame resistant elastomeric coating.

U.S. Pat. No. 5,965,223 to Andrews et al, which is herein incorporated by reference discloses a composite layer protective fabric having an outer primary layer of an abrasive material and an inner later of cut resistant material positioned below the outer layer.

In each case the prior art discussed above requires a fabric having a plurality of layers to achieve the protection desired. Usually each layer being entirely fabricated of a uniform composite structure throughout the fabric. Thus the weight of the fabric is increased and the flexibility and comfort level of the wearer of the garment produced is decreased. Furthermore, the extensive use of high performance filaments throughout the fabric makes the articles of manufacture more expensive.

Therefore, exists a need for flexible and comfortable multi-layered fabric such as for a glove that is less expensive, more efficient to fabricate, and reduces the amount of high performance filaments yet provides the necessary protective characteristics at the areas requiring the most protection.

SUMMARY OF THE INVENTION

In accordance with the present invention a multi-layer flexible textile fabric is produced in which the base or bottom is a unilayer of interlocking or intertwining of at least one insertion fiber into preselected patterns at definite locations or regions of the base fabric by essentially conventional textile manipulating techniques controlled by a computer. The base fabric is formed from natural material or synthetic polymer fibers of the same or different denier than the insertion fiber. The "insertion fiber" may be of the same or different material than the base fabric. The insertion fibers may include performance filaments which can be used and have a high tensile modulus of elasticity, about 5,000 $kg/mm^2$ or more. The high tensile modulus filaments used may vary widely and include organic and inorganic filaments depending on the functional use. However, these high performance materials are very expensive and reducing the amounts without sacrificing performance is accomplished by the present invention.

For comfort and economic reasons the base fabric is manufactured preferably from a lighter and less expensive natural fiber such as cotton. As mentioned above, the type of high tensile modulus filament to be used is predicated on improving the effectiveness of the fabric for an intended function. For example, if garments are expected to provide protection to the wearer from hazards such as abrasions, cuts, and punctures, a cut resistant filament is knittingly secured into the base fabric by a computer controlled pattern device. The encoded pattern information (design and location data) will direct the manipulation of the needles to interlock the filaments. In the case of a garment such as a glove, all regions where such reinforcement is needed, which could include shoulder length gloves, the present invention can be used. Preferably the interlocking step is done by knitting. The high tensile modulus filaments are selected for the group consisting of aramides, extended chain polyethylenes, extended chain polypropylenes, liquid crystal polyesters, polyolefins, polyesters, polyamides, carbon fibers, metal fibers, fibergiass, and mixtures thereof.

On the top of the unilayer base fabric having the protective areas of different fibers or yarn or different denier fibers or yarn may be knitted, an additional layer with or without the different deniers or different fibers depending upon the use of the fabric. Also, the unilayer base fabric may be overknitted to provide a terry inner layer such as for a glove.

One of the advantages of having a unilayer upper layer is that there is provided protection, for example in glove, at selective areas without sacrificing the flexibility or stretchability of fabric such as when an entire area comprises synthetic fibers.

More specifically, there is provided a multi-layer textile performance fabric for use in a garment, for example, a protective glove and a method for its preparation. Accordingly, a unilayer bottom or base fabric is prepared having a pattern formed thereon by a step of selectively manipulating into the fabric at least one insertion fiber or yarn of a different material or denier by computer manipulation to form a single layer for the base fabric and pattern of insertion fiber or yarn. Then an additional layer is knitted on the base fabric.

The invention provides a method of manufacturing a multi-layer flexible performance textile fabric having an insertion fiber of a heavier denier or different material interlocked or intertwined within a base fabric as a bottom layer to enhance an intended function. The first step involves manipulating the lower denier fiber using substantially conventional textile fabric forming technology such as stitching to form a basic fabric. The next step also follows conventional techniques such as by knitting the heavier denier insertion fiber base fabric wherein the placement and design of the pattern of the heavier denier fiber is controlled by the pattern data supplied to a microprocessor to which the manipulations of the knitting needles are responsive providing the pattern programmed in the same single layer as the base fabric. A second layer is then added onto the base layer by the same technique or by plating or providing a terry construction.

It is the primary objective of the invention to provide a fabric that enhances the performance of an intended function, yet reduces the weight of the apparel or article of manufacture with single layer construction.

Another object of the invention is to provide a fabric containing high tensile modulus filaments of a heavier denier in pre-selected locations within the fabric.

A further object of the invention is to provide a large variety of apparel and articles fabricated from the fabric of the invention.

A still further object of the present invention is to provide performance apparel used for protection against numerous potential hazards.

Yet another object of the present invention is to maximize the effectiveness of expensive high performance material.

Still another object of the present invention relates to articles of manufacture fabricated totally or in part of a glove from fabric of this invention.

Another object of the present invention is to provide a glove construction of a fabric with high tensile modular filaments of a heavier denier than the base fabric and knitted into the base fabric conforming to the pattern and location programmed and controlled by a computer to form "islands of reinforcement" in the finger, thumb, palm, heel, wrist, and arm regions against sharp object. Also, to place at least one additional fabric layer for comfort or safety.

DETAILED DESCRIPTION OF THE PREFERRED EMBODIMENTS

Figure 1:
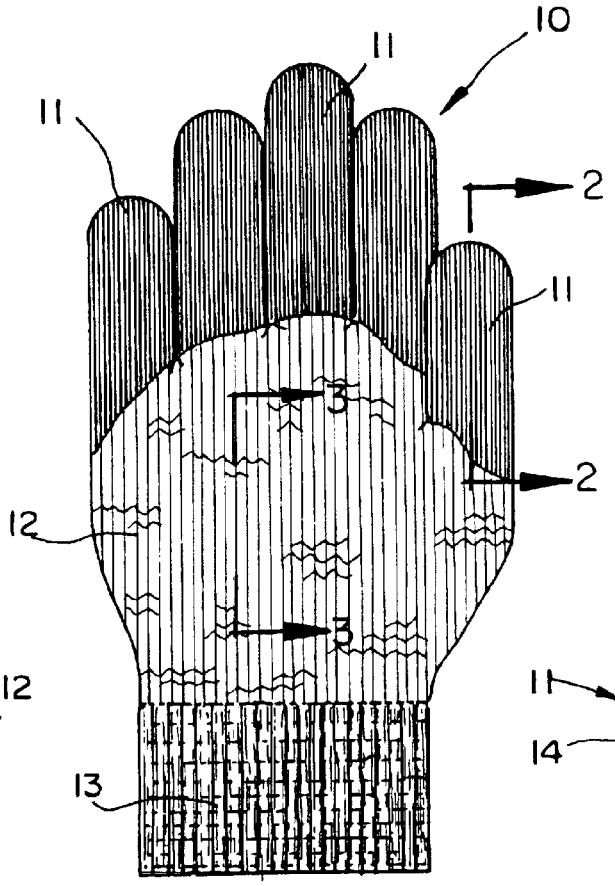
FIG. 1 is a glove formed by the method of the invention.

As shown in FIG. 1 there is provided a fabric in the form of a knit glove 10 with an elastic band 13 and having a substantial area of cotton 12 of a heavier denier with a high modulus synthetic fiber such as KEVLAR® formed on the outside.

Figure 2:
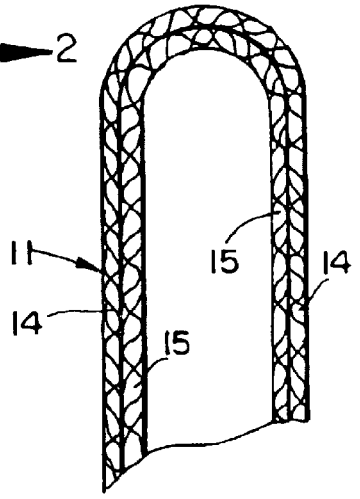
FIG. 2 is a sectional view, taken generally along line 2—2 in FIG. 1 showing the construction of the thumb stall.
Figure 3:
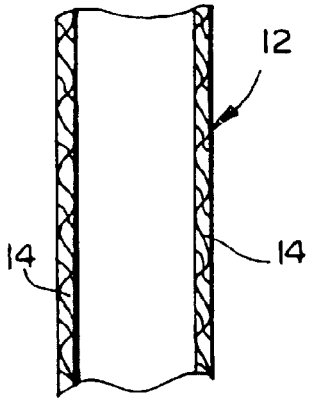
FIG. 3 is a sectional view taken generally along line 3—3 in FIG. 1 showing single layer construction.

As shown in FIG. 2, the finger portions 11 of the glove 10 comprises an outer layer 14 and an inner layer 15. The outer later is of a unilayer construction in the finger portions 11 as well as the palm portion 12. The finger portions 11 contain a further knit fabric layer 15 attached to said outer layer 14 of the fingers 11.

The base fabric product of the invention is made using chain stitches. The machine picks up the programmed material carrier and at the same time pre-selected needles raise up to knit the material. Then this material is dropped off and another material carrier is picked up which then knits this material in a pre-selected location. Using this process one is able to put material in any location in the product. A second layer can be placed on the base fabric utilizing the same techniques or can be plated or provided in a terry construction.

The present invention in its broadest aspect is a flexible textile performance fabric comprising a base fabric formed from a first fiber having the design of a desired pattern formed therein by intertwining or interlocking in the same layer at least one insertion fiber of a heavier denier than the base fiber which can be manipulated in accordance with conventional textile fabric manufacturing process but wherein such manipulation is computer controlled. A programmed computer encodes the location(s) and the design of the desired pattern. After such data is entered, this enables the manipulation processes to place such designs in designated locations. This effectively maximizes the benefits of the expensive high performance material while reducing the amount of material needed. For example, if abrasion resistance is needed in an anti-wear garment, only those areas requiring this added performance, i.e., elbows and knees, would have the performance filaments to provide the desired characteristics. Then at least one addition fabric similar to the unilayer base fabric may be added or using conventional means such as plating or providing terry construction.

Broadly, a method of manufacture of the flexible performance textile fiber comprises the steps of:

(a) manipulating a first fiber in a conventional manner to form a base textile fabric in a single layer; and (b) manipulating at least one insertion of a fiber having a greater denier or of a different material into the base textile fabric wherein this step of manipulating is computer controlled to produce a predetermined design for a pattern at a pre-selected location within the base textile fabric to form a performance fabric having enhanced performance function.

The first manipulative step involves a stitching operation which is performed by a knitting, sewing, or weaving machine to form a base textile fabric having a mesh or web configuration. The base is then downloaded into a knitting machine. The base textile fabric can comprise fibers, for example of a denier of about 15 to 1800 and comprise synthetic or natural fibers.

The type of stitching in the first manipulative step may vary widely. Stitching and sewing methods such as chain stitching, lock stitching, and the like are illustrative of the type of stitching used for use in this invention. The nature of the stitching fiber or thread will also vary widely and any type of fiber can be used depending on the garment and its use.

More specifically, in a further step the manipulation of the dissimilar denier fiber or kind of fiber into the base textile fabric is conducted on a programmed knitting machine. The programming means comprises a microprocessor connected electronically to a programming matrix that controls a fiber carrier while simultaneously activating a needle selection means responsive to an output signal from the microprocessor and then to a pre-selected needle which knits the insertion fiber into the web of the base fabric. This fiber carrier is released and in response sends a corresponding impulse to the microprocessor consistent with the input of the pattern and location data; another fiber carrier carrying another insertion fiber supplies the fiber to the pre-selected needle which knits the filament into the proper location in the web of the base fabric. The fibers can have a denier up to 6000. The same operation can be used to place a further layer on the base fiber and the location of the performance fibers can be varied.

The invented fabric can be produced on essentially conventional computer controlled textile fiber manufacturing equipment to produce such textile mechanical manipulative functions of sewing, knitting, or weaving that are capable of producing the interlocking or intertwining steps of at least one dissimilar performance fibers into the base fabric and where this equipment is modified to effect the computer controlled processes described.

Several advantages flow from this arrangement. The design of the pattern and the textile mechanical manipulation step or steps for both the base fabric and the additional layer may be placed into coding matrix electrically connected to the microprocessor unit. This input data may be stored as electrical data on any desired medium, such as a disc or a tape. Once this data has been entered, the manipulative steps, i.e. knitting, can take place normally without any necessity to stop the machine or in general terms where to locate the design on the base fabric and where the pattern should begin and end. Units of pattern information so stored are read in sequential order of knitting and are translated into pattern data for needle selection in each knitting course and/or control data for controlling knitting, transfer, rocking and like operations in each knitting course.

The following definitions are supplied in order to more clearly point out the present invention and to avoid ambiguity.

The term "fiber" is meant any thread, filament, or the like, alone or in groups of multifilaments, continuous running lengths or short lengths such as staple. Fiber is defined as an elongated body, the length dimensions of which are much greater than the dimensions of width and thickness. Accordingly, the term fiber, as used herein includes a monofilament elongated body, a multifilamented elongated body, and the like having regular or irregular cross sections. The term fibers includes a plurality of any one or a combination of the above.

The cross-section of fibers for use in this invention may vary widely. Useful fibers may have a circular cross-section, oblong cross-section or irregular or regular multi-lobal cross-section having one or more regular or irregular lobes projecting from the linear or longitudinal axis of the fibers. In the particularly preferred embodiments of the invention, the fibers are of substantially circular or oblong cross-section and in the most preferred embodiment are of circular or substantially circular cross-section.

The term "filament" as used herein refers to a strand of indefinite or extreme length. This term includes manufactured strand produced by extrusion processes, inter alia.

In this disclosure the terms "fiber", "filament", and "yarn" are used interchangeably. The term "yarn" is meant any continuous running length of fibers or filaments which may be wrapped with similar or dissimilar fibers, suitable for further processing into fabric by braiding, weaving, fusion bonding, tufting, knitting, or the like, having a denier less than 10,000.

The term "strand" is meant either a running length of multifilament end or a monofilament end of continuous fiber or spun staple fibers, preferably untwisted having a denier of less than 2,000.

The term "insertion fiber" is meant any fiber or filament or yarn of a heavier denier than the base fiber. The insertion fiber may be of the same or different material than the base fiber. The type of fibers used in the fabrication of the present unilayer include natural and synthetic polymer fibers and inorganic filaments.

The term "denier" is a unit of weight indicating the finesse of the fiber, filament, or yarn equal to a yarn weighing one gram per each 9000 meters.

The term "overall denier" refers to the denier of a single strand or the combined denier of two or more strands. Again other overall denier sizes may be used depending on a number of factors to include, but not limited to, the knitting equipment that will be employed and to the end use of the knit article.

The strands for both the base fiber and the insertion fiber may be comprised of any suitable natural or synthetic material suitable for use in a knitting operation. Suitable materials include nylon, polyester, polyester-cotton blends, cotton, wool, and acrylic fibers. The strands may either be spun or textured. The denier of the additional strands will vary depending on the equipment available and the desired final size of the composite yarn.

The heavier denier fabrics can be of equal or different denier and each has a denier within the range of about 500 to 6,000 and preferably within the range of about 1,000 to about 5,200. The lighter denier yarns which make up the base fabric can also be equal or different and each has a denier within the range of about 220 to about 1,800.

Individual fibers or filaments may have a denier of about 50 to about 300. More preferably, the fibers may have a denier of between 175 to about 250.

The "insertion fiber" can be any fiber or yarn of a heavier denier than the base fabric which may be inclusive of a fiber or filament having modular of elasticity of about 5,000 $kg/mm^2$ or more that provides an enhanced performance function, such as in cut resistance, abrasion resistance, heat resistance, or the like.

In general the specific filament or fiber combination which is employed in any particular situation will depend to a large intent to the functional use of the apparel or article. In the present invention along with enhancing the performance characteristics of the garment or article, the single layer construction for the base fabric reduces the weight and increases the flexibility and comfort factor. Furthermore, since the insertion fiber can be specifically located anywhere on the fabric and when the insertion is a high performance fiber, the amount along with the expense can be reduced in the manufacture of a garment without the performance feature being diminished. The base fabric can be adapted for special uses by the addition of a further layer.

Preferably the filaments having a high tensile modulus of elasticity of 5,000 $kg/mm^2$ or more are usable for the performance fibers which are knitted into the base fabric or the additional layer with the proviso that the denier is heavier. Illustrative of the useful organic fibers having a high tensile modulus are those selected from the group consisting of aramid fibers, liquid crystal, copolyester fibers, nylon fibers, polyacrylonitrile fibers, polyester fibers, high molecular weight polyvinylalcohol fibers, and ultra high molecular weight polyolefin fibers and mixtures thereof.

High molecular weight polyethylene and polypropylene fibers are polyolefin fibers that may be used as performance fibers in preferred embodiments. In the use of polyethylene, suitable fibers are those which have a molecular weight of at least 150,000 preferably at least one million, and more preferably between two and five million. Such extended-chain polyethylene (EC PE) fibers are a high tensile material which are inherently resistant, as well as being abrasion resistant and flexible providing a superior cut resistant yarn especially for protective gloves. SPECTRA® is a tradename of an ultra high molecular weight extended-chain polyethylene that is marketed.

Similarly, high oriented polypropylene fibers of molecular weight at least of 20,000 preferably at least a million, and more preferably at least two million may be used. Such high molecular weight polypropylene may be formed into reasonably well oriented fibers by techniques prescribed in U.S. Pat. No. 4,551,293 which is herein incorporated by reference. The particularly preferred ranges for the above-described parameters can advantageously provide improved performance in the final article and employed as a performance fiber.

High molecular weight polyvinyl alcohol fibers having a high tensile are described in U.S. Pat. No. 4,440,711 which is herein incorporated by reference. In the case of polyvinyl alcohol (PV-OH), PV-OH fibers having a weight average molecular weight of at least 200,000 may be used. Particularly useful PV-OH fibers should have a tensile modulus of at least 5,000 kg/mm$^2$ or more. Most preferred fibers are poly-p-phenylene terephthalate filaments marketed under the tradename KEVLAR® and poly-m-phenylene terphthalate marketed under the tradename NOMEX® each by E.I. DuPont de Nemours & Co., Inc., Wilmington, Del. Each such aramid fiber has strong high temperature resistant, cut resistant, puncture resistant and abrasion resistant properties. Most preferred are para-aramide fibers having a high tensile modulus of elasticity of about 7,100 km/mm$^2$.

Another high tensile fiber useful in certain applications of this invention is formed from polybenzimidazole polymers available from Celenese Corporation, Chatham, N.J., under the tradename P.B.I.® fibers.

Polyacrylonitrile (PAN) fibers of a molecular weight of at least 400,000 are suitable. Such fibers are disclosed in U.S. Pat. No. 4,535,027 which is herein incorporated by reference.

Liquid crystal copolyesters suitable in this invention are disclosed in U.S. Pat. Nos. 3,975,487, 4,118,372 and 4,161,470 all herein incorporated by reference.

In the case of nylon fibers, suitable fibers include those formed from nylon 6, nylon 10, and the like.

Suitable polyester fibers include polyethylene terephthalate.

Illustrative of useful inorganic fibers having high tensile modulus are those selected from the group consisting of S-glass fibers, E-glass fibers, steel filaments, carbon fibers, boron fibers, aluminum fibers, zirconic-silica fibers, aluminum silica fibers, and mixtures thereof. Preferred are glass fibers having a tensile modulus of elasticity of about 7,000 kg/mm$^2$. Preferred steel filaments have a tensile modulus of elasticity of about 20,000 kg/mm$^2$.

Low tensile modulus fibers having a tensile modulus of 3,000 kg.mm$^2$ or less are effective for importing the high degree of flexibility to the unilayer base fabric or additional layer and the subsequent garment manufactured therefrom.

The synthetic fibers are preferably selected from the group consisting of viscose rayon fibers, aliphatic polyamide fibers, polyacrylic fibers, polyester fibers, water insoluble modified polyvinyl alcohol fibers and mixtures thereof. Most preferred fibers are natural fibers such as cotton and wool. Both fibers have the flexibility characteristics desired and provide a proper comfort level to the wearer. For these reasons they can be positioned proximate to the wearers skin.

Fibers having a relatively low tensile modulus can be used independently or together with ordinary relatively low tensile modulus fibers, without difficulty, in the method of this fiber.

The performance fiber can also be a blend of mixed fibers, i.e. a lower strength fiber with the high stretch fiber. Likewise, the performance fiber could be a composite fiber wherein the matrix is a softer material impregnated with a hard material such as carbon or glass fibers.

In addition, the fibers can be composed of fibers with anti-microbial additives or otherwise impregnated with an anti-microbial agent.

Even one skilled in the art might assume that the hard fibrous materials used as part of this invention would be very brittle and therefore of limited use in protective garments where flexibility and comfort are of major concern. The glass or steel filaments which are normally used as performance fibers are extremely small in diameter but could still be larger than the base fabric. If a larger diameter is required, an impregnated fiber, described above can be used. As a result, these hard materials are still very flexible and can be bent round a very small radius without breaking. In this embodiment it is preferred that the hard fibrous material is located within the matrix of the yarn. By placing the hard material in the matrix of the yarn, the hard material is exposed to the least stress during the bending of the yarn. Furthermore, by placing the hard material within the matrix, the outer portion of flexible material helps to protect the more brittle, harder component.

In many cases, it will be preferred that the hard fibrous material be coated with a continuous layer of elastic material. This coating has several functions. For example, if the hard material is a multifilament fiber, the coating holds the fiber bundle together and helps protect it from stresses that develop during the manufacturing process. Furthermore, the coating may provide a physical or chemical barrier for the hard material. Finally, if the hard material is broken during use, the coating will trap the material so that it will not leave the fibrous structure.

It is to be understood that the present invention provides for a multiplicity of embodiments by using any number of protective materials in combinations to form a composite fabric. Consequently, the invented fabric can be made into a large variety of articles and protective apparel used for protection against numerous potential hazards.

EXAMPLE 1

A glove having isolated patterns of high denier fibers in critical locations is prepared.

The method of manufacture involves first chain-stitching a 100 percent cotton 55 denier fiber on a programmed flat knitting machine, such as described in U.S. Pat. No. 4,479, 368 to form a unilayer base fabric in a mesh and web construction having a weight of about 4 to 7 oz/sq yd. After the base fabric is formed it is downloaded into a knitting machine into which the design of the isolated patterns have been programmed. A cotton fiber having a denier of the individual filament of 1500 is knitted into the same layer as the mesh and web of the basic fabrics. The movement of the knitting needle with respect to the palm portion and the finger and thumb stalls is controlled by a computer. A second layer is then knitted onto the base fabric using a similar technique or conventional plating methods.

To complete the assembly of the glove, the edges of the back and palm portions, along with the finger and thumb stalls of the two layers are secured by sewing in suitable fibers.

The glove has the desired qualities of high gripability, flexibility, and softness.

It should be apparent to those skilled in the art, that other embodiments, improvements, details, and uses can be made consistent with the letter and spirit of the foregoing disclosure and within the scope of this patent, which is limited only by the following claims, construed in accordance with patent statutes, including the doctrine of equivalents.

What is claimed is:

1. A multi-layer flexible textile performance fabric for a protective garment comprising a unilayer base fabric having a predetermined pattern continuously formed therein by a step of selectively manipulating and chain stitching on a programmed knitting machine into said fabric at least one insertion fiber of a different material or denier in the same layer with a preselected single needle wherein said step of manipulation is computer controlled to form a single layer, and at least one additional fabric knitted on said base fabric.

2. The performance fabric of claim 1 wherein said at least one additional fabric is of a unilayer construction.

3. The performance fabric of claim 2 wherein said at least one additional fabric comprises insertion fibers of a different material.

4. The performance fabric of claim 2 wherein said at least one additional fabric comprises a fabric having insertion fibers with different denier fibers or yarn material.

5. The performance fabric of claim 2 wherein said at least one additional fabric comprises areas of different denier insertion fibers.

6. The performance fabric of claim 2 wherein said at least one additional fabric comprises islands of synthetic fibers in combination with natural fibers.

7. The performance fiber of claim 6 wherein said synthetic fibers are selected from the group consisting of rayon fibers, aliphatic polyamide fibers, polyacrylic fibers, polyester fibers, water-insoluble modified polyvinyl alcohol fibers and mixtures thereof.

8. The performance fabric of claim 1 wherein said insertion fibers are inorganic.

9. The performance fabric of claim 1 wherein said additional fabric is on top of said base layer and is plated.

10. The performance fabric of claim 1 wherein said additional fabric is on the bottom of said base layer and is of terry construction.

11. The performance fabric of claim 1 wherein said additional fabric is on the bottom of said base layer and is placed by plating.

12. The performance fabric of claim 1 wherein said base fabric is formed of fibers having a tensile modulus of elasticity of 3,000 kg/mm$^2$ or less.

13. The performance fabric of claim 1 wherein said base fabric is formed of fibers of a denier in the range of about 50 to 300.

14. The performance fabric of claim 1 wherein the insertion fiber is of the denier is in the range of about 100 to 5200.

15. The performance fabric of claim 1 wherein said insertion fiber has a high tensile modulus of elasticity of 5,000 kg/mm2 or more and a denier in the range of about 500 to 6,000.

16. The performance fabric of claim 1 wherein said fibers are natural fibers.

17. The performance fabric of claim 1 comprising a cotton glove wherein said base fabric has at least one island of a unilayer organic polymer or inorganic fibers of a denier from about 500 to 6,000.

18. A multi layer protective fabric comprising a unilayer base fabric formed by continuously chain-stitching a first fiber of a lighter denier, said base fabric having a design of a pattern formed therein by the step of manipulating into the same layer as said base fabric at least one insertion fiber of a heavier denier, wherein said step of manipulating comprises a single needle controlled by an output signaling a programmed microprocessor so as to form at least one island of high denier fiber, and a second fabric knitted on said base fabric.

19. The protective fabric of claim 18 that is a glove.

20. A method of manufacturing the protective fabric of claim 18 comprising the steps of:

(a) preparing a base fabric by manipulating and chain stitching a first fiber of high denier to form a base textile fabric in a unilayer;

(b) manipulating at least one insertion fiber of a heavier denier of a different material into said base fabric to form a single layer, wherein the step of manipulating said single needle is computer controlled to produce a predetermined design for pattern to form a performance fabric having enhanced performance functions; and (c) knitting a fabric layer on of said base fabric layer.

* * * * *